US007761038B2

(12) United States Patent
Moon et al.

(10) Patent No.: US 7,761,038 B2
(45) Date of Patent: Jul. 20, 2010

(54) IMAGE FORMING APPARATUS AND DEVELOPER SUPPLYING DEVICE TO IMPROVE PRINTING QUALITY

(75) Inventors: Ji-won Moon, Anyang-si (KR); Hyun-cheol Lee, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 12/015,049

(22) Filed: Jan. 16, 2008

(65) Prior Publication Data

US 2008/0193168 A1 Aug. 14, 2008

(30) Foreign Application Priority Data

Feb. 13, 2007 (KR) ..... 10-2007-0015063

(51) Int. Cl.
*G03G 15/08* (2006.01)

(52) U.S. Cl. ..... 399/260

(58) Field of Classification Search ..... 399/258, 399/262, 260

See application file for complete search history.

(56) References Cited

U.S. PATENT DOCUMENTS 4,435,065 A * 3/1984 Wada ..... 399/260
4,969,011 A * 11/1990 Faull et al. ..... 399/58
5,345,298 A * 9/1994 Corrigan, Jr. ..... 399/260
5,402,216 A * 3/1995 Komaki et al. ..... 399/260
5,557,382 A 9/1996 Tatsumi et al.
5,729,803 A * 3/1998 Nakaue et al. ..... 399/261
6,763,215 B1 * 7/2004 Jones ..... 399/260
6,934,493 B2 * 8/2005 Murakami ..... 399/258

FOREIGN PATENT DOCUMENTS

JP 04031879 A * 2/1992
JP 2007264030 A * 10/2007
KR 1999-50147 7/1999

* cited by examiner

*Primary Examiner*—Quana M Grainger
(74) *Attorney, Agent, or Firm*—Stanzione & Kim LLP

(57) ABSTRACT

An image forming apparatus includes a developing unit which comprises a unit casing to form a developing chamber, and a rotating body which is rotatably provided in the developing chamber, a developer supplying unit to store a developer therein, and comprises a plurality of developer outlets which are overlapped or in contact with each other along a rotation direction of the rotating body on an outside surface thereof.

18 Claims, 11 Drawing Sheets

IMAGE FORMING APPARATUS AND DEVELOPER SUPPLYING DEVICE TO IMPROVE PRINTING QUALITY

CROSS-REFERENCE TO RELATED APPLICATIONS

This application claims priority under 35 U.S.C. §119(a) from Korean Patent Application No. 10-2007-0015063, filed on Feb. 13, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus to increase fluidity of a developer supplied to a developing chamber.

2. Description of the Related Art

In general, an electrophotographic image forming apparatus includes a laser printer, a photocopier, a multi-functional machine, etc., as an electronic apparatus forming an image on a printing medium through charge, exposure, development, transfer, and fusing processes.

As illustrated in FIG. 1 through 2B, a conventional image forming apparatus 1 includes a developing unit 20, a developer supplying unit 10 supplying a developer to a developing chamber J, and a transferring roller 30.

The developing unit 20 has a unit casing 21 forming the developing chamber J, and a plurality of rotating bodies 22, 23, 24, 25, and 26 accommodated in the unit casing 21.

The plurality of rotating bodies include a photosensitive body 24, a charging roller 22, a cleaning roller 23, a developing roller 25, and a supplying roller 26. The charging roller 22 charges a surface of the photosensitive body 24 to a predetermined electric potential, and the cleaning roller 23 cleans a residual developer on the charging roller 22.

The developing roller 25 develops the photosensitive body 24 with the developer that is supplied into the developing chamber J by the developer supplying unit 10. Also, the supplying roller 26 charges the developer provided to the developing chamber J by friction due to the same rotating direction with the developing roller 25, and supplies the charged developer to the developing roller 25.

The developer supplying unit 10 includes a developer supplying member 13 and an agitator 15. The developer supplying member 13 has a shape of a hollow pipe. The developer supplying member 13 receives the developer from a developer storing tank (refer to FIG. 4). The agitator 15 is disposed in the developer supplying member 13 and stirs the developer so as not to be cohered.

The developer supplying member 13 includes a developer outlet 14 which communicates with the developing chamber J and through which the developer is supplied to the developing chamber J. The developer outlet 14 may have a trapezoid shape as illustrated in FIG. 2A or a circular shape as illustrated in FIG. 2B.

There is no separate member in the developing chamber J, which moves the developer passed through the developer outlet 14 in a transverse direction to a feeding direction D of a printing medium P. Accordingly, the developer supplied to the developing chamber J through the developing outlet 14 is not evenly applied in the transverse direction to the feeding direction D. Thus, the image formed on the printing medium P varies in concentration along the transverse direction to the feeding direction D.

Particularly, an interval portion S between the developer outlets 14, where the developer is blocked from the developer supplying member 13, may be largely different in image concentration from a lengthwise portion L of the developer outlet 14 along the transverse direction to the feeding direction D.

The concentration difference can be confirmed with the naked eye by the printing medium P being entirely printed thereon with a yellow developer, and then a black developer is additionally provided to the developer storing tank. Then, the printing medium P printed thereon with the yellow developer is also printed thereon with the black developer. FIG. 3 is one portion of the photographed printing medium P printed thereon with the black developer.

As illustrated in FIG. 3, the image varies in concentration along the transverse direction to the feeding direction D. That is, referring to FIG. 3, the image concentration of an "A" portion corresponding to the developer outlet 14 is much higher than other regions not including the "A" portion.

The developer outlets 14 can be made as a single outlet along the lengthwise direction of the developer supplying member 13 without the interval portion S, so as to reduce the difference in the image concentration. However, this structure disadvantageously causes the developer supplying member 13 to be fragile.

SUMMARY OF THE INVENTION

Accordingly, the present general inventive concept provides an image forming apparatus to reduce a concentration difference of a developer in a transverse direction to a feeding direction of a printing medium.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus comprising a developing unit which comprises a unit casing to form a developing chamber, and a rotating body which is rotatably provided in the developing chamber, a developer supplying unit to store a developer therein, and comprises a plurality of developer outlets which overlap or in contact with each other along a rotation direction of the rotating body on an outside surface thereof.

The developer supplying unit may comprise a developer storing tank, and a hollow developer supplying member accommodated in the developing chamber.

The hollow developer supplying member may comprise a developer inlet through which the developer of the developer storing tank flows in and the plurality of developer outlets formed on an outside surface thereof.

The developer outlet may be provided as at least one slit.

The developer outlet may be provided in a crossing direction to a centerline of the developer supplying member.

The developer outlet may comprise a first outlet row which comprises a plurality of first developer outlets spaced apart from each other along a lengthwise direction of the developer supplying unit, and a second outlet row which comprises a plurality of second developer outlets alternately disposed to the first developer outlets, and is spaced apart from the first outlet row in the transverse direction to the lengthwise direction.

At least one of the first developer outlet and the second developer outlet may have a triangle shape.

At least one of the first developer outlet and the second developer outlet may have an oval shape.

The image forming apparatus may further comprise an agitator which may be provided inside the developer supplying member and agitates the developer.

The developer outlet may be provided as at least one slit.

The developer outlet may be provided in a crossing direction to a centerline of the developer supplying member.

The developer outlet may comprise a first outlet row which comprises a plurality of first developer outlets spaced apart from each other along a lengthwise direction of the developer supplying unit.

The developer outlet may further comprise a second outlet row which comprises a plurality of second developer outlets alternately disposed to the first developer outlets, and can be spaced apart from the first outlet line in the transverse direction to the lengthwise direction.

At least one of the first developer outlet and the second developer outlet can have a triangle shape.

At least one of the first developer outlet and the second developer outlet can have an oval shape.

The foregoing and/or other aspects and utilities of the general inventive concept may also be achieved by providing a developer supplying unit usable with an image forming apparatus, the developer supplying unit comprising a developer supplying member having a developer storing portion to store developer and a plurality of developer outlets arranged along a lengthwise direction of the developer supplying member to emit the developer to a supplying roller of the image forming apparatus, wherein at least a portion of each adjacent developer outlet overlaps each other in the lengthwise direction.

The foregoing and/or other aspects and utilities of the general inventive concept may also be achieved by providing an image forming apparatus, comprising a supplying roller, and a developer supplying unit comprising a developer supplying member having a developer storing portion to store developer and a plurality of developer outlets arranged along a lengthwise direction of the developer supplying member to emit the developer to the supplying roller, wherein at least a portion of each adjacent developer outlet overlaps each other in the lengthwise direction.

BRIEF DESCRIPTION OF THE DRAWINGS

These and/or other aspects and utilities of the present general inventive concept will become apparent and more readily appreciated from the following description of the embodiments, taken in conjunction with the accompanying drawings, in which.

DETAILED DESCRIPTION OF THE PREFERRED EMBODIMENTS

Figure 1:
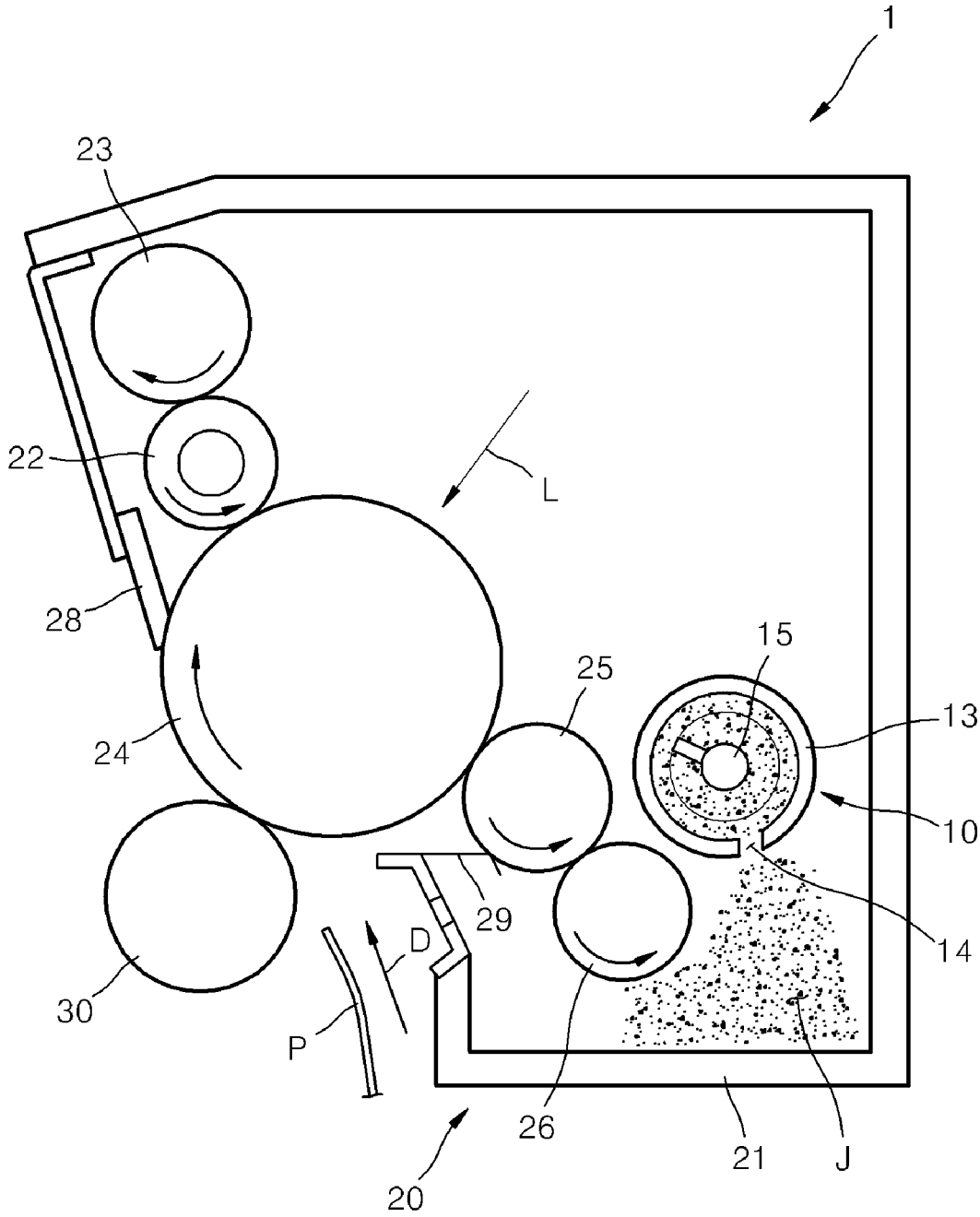
FIG. 1 (RELATED ART)
FIG. 1 is a schematic sectional view illustrating a conventional image forming apparatus.

Reference will now be made in detail to embodiments of the present general inventive concept, examples of which are illustrated in the accompanying drawings, wherein like reference numerals refer to like elements throughout. The embodiments are described below so as to explain the present general inventive concept by referring to the figures.

Figure 4:
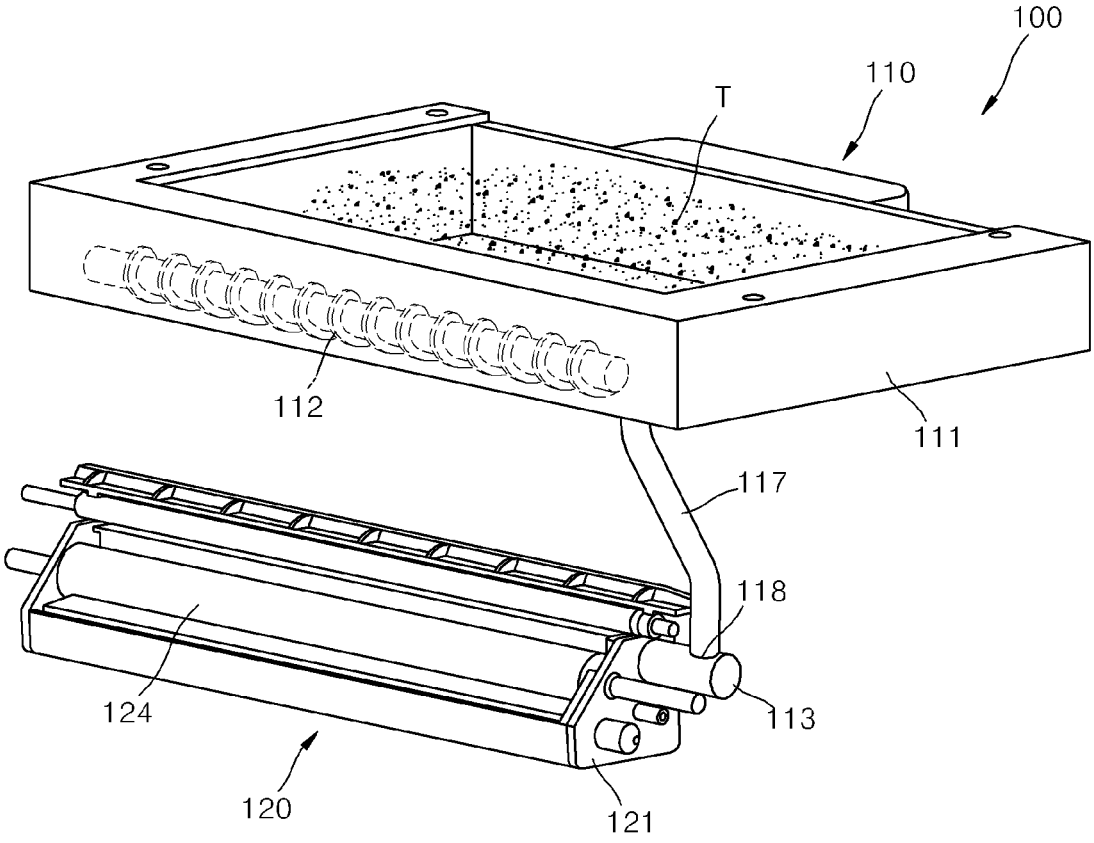
FIG. 4 is a schematic perspective view illustrating an image forming apparatus according to the present general inventive concept.
Figure 5:
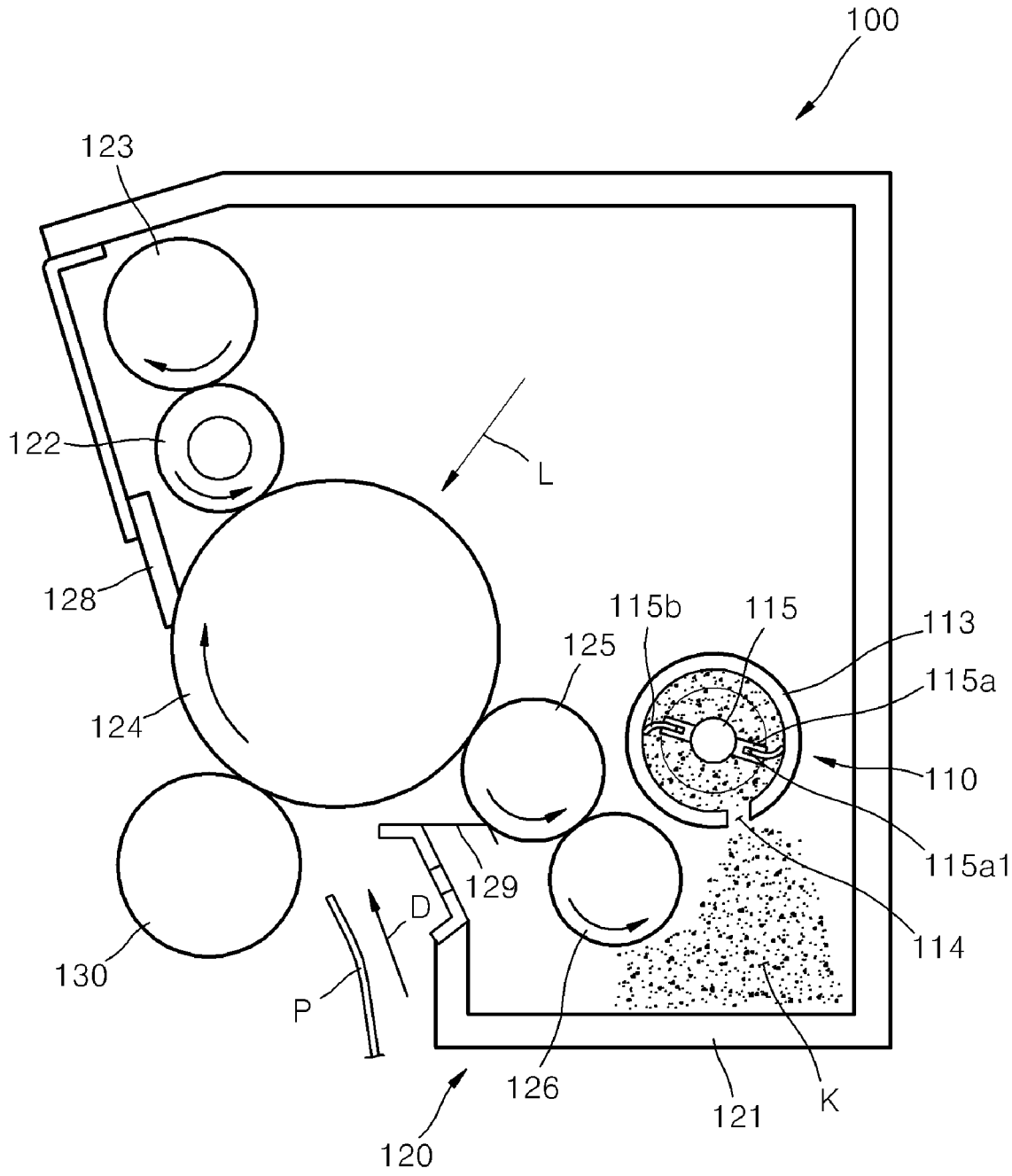
FIG. 5 is a schematic sectional view illustrating the image forming apparatus in FIG. 4.

As illustrated in FIGS. 4 and 5, an image forming apparatus 100 according to an embodiment of the present general inventive concept may include a developer supplying unit 110, a developing unit 120, and a transferring unit 130.

As illustrated in FIG. 5, the developing unit 120 includes a unit casing 121 to form a developing chamber K, rotating bodies 122, 123,124,125, and 126 which are rotatably provided in the developing chamber K, a cleaning blade 128, and a doctor blade 129.

The rotating bodies 122, 123, 124, 125, and 126 include a charging roller 122, a cleaning roller 123, a photosensitive body 124, a developing roller 125, and a supplying roller 126. Unlike those illustrated in the figures, the photosensitive body 124 may be provided outside the unit casing 121, and the cleaning roller 123 may be omitted. The number and size of the rotating bodies may vary as necessary.

The developer supplying unit 110 has a developer storing tank 111 to store a developer T to be supplied to the developing chamber K, a developer conveying member 117, and a developer supplying member 113.

An auger 112 can be accommodated inside the developer storing tank 111. The auger 112 conveys the developer T toward the developer conveying member 117, and prevents the developer T from cohering to each other. An agitator may be used instead of the auger 112 as necessary.

The developer conveying member 117 conveys the developer from the developer storing tank 111 to the developer supplying member 113, and can be shaped like a hollow pipe. As illustrated in FIG. 4, a first end portion and a second end portion of the developer conveying member 117 are connected to the developer storing tank 111 and the developer supplying member 113 (to be described later), respectively.

Accordingly, the developer supplying member 113 supplies the developer conveyed from the developer conveying member 117 to the developing chamber K.

As illustrated in FIG. 4, the developer supplying member 113 is connected to the developer conveying member 117 and has a developer inlet 118 through which the developer flows from the developer storing tank 111. As illustrated in FIG. 4, the developer supplying member 113 having the developer inlet 118 to receive the developer from the developer conveying member 117 may pass through the unit casing 121. A sealing member can be provided in a supplying member through hole (not illustrated) of the unit casing 121, through which the developer supplying member 113 passes, so that the developer does not leak.

Also, as illustrated in FIG. 5, the developer supplying member 113 has the developer outlet 114 and supplies the developer received through the developer inlet 118 to the developing chamber K.

The unit casing 121 accommodates a portion of the developer supplying member 113 having the developer outlet 114 so that the developer outlet 114 can communicate with the developing chamber K.

Figure 6:
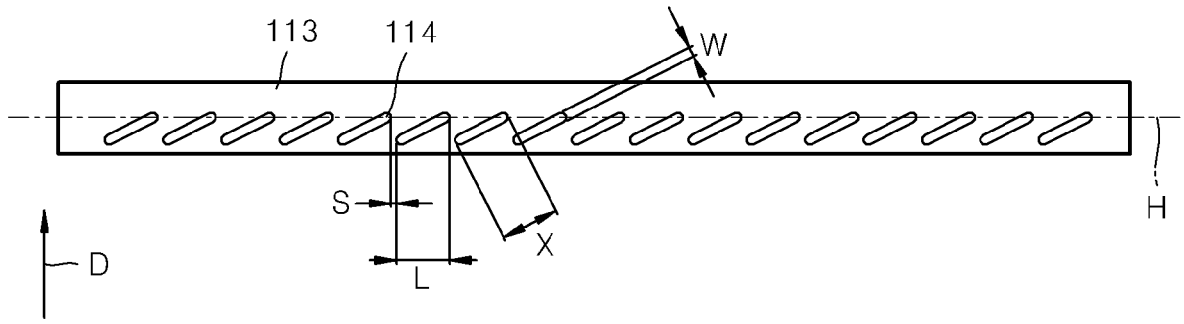
FIG. 6 is a schematic plan view illustrating a developer supplying member of the image forming apparatus in FIG. 4.

As illustrated in FIG. 6, the plurality of developer outlets 114 are formed along the lengthwise direction of the developer supplying member 113. Each developer outlet 114 may be formed as a slit shape of a narrow width W and a long length X.

In an exemplary embodiment of the present general inventive concept, the developer outlets 114 are closely disposed so as to shorten an interval S between the developer outlets 114 in a transverse direction to a feeding direction D.

Also, the developer outlet 114 may be aligned in a crossing direction to a centerline H of the developer supplying member 113. That is, the lengthwise direction of the developer outlet 114 may be crossed with the centerline H. Accordingly, the length of the developer outlet 114 crossing the centerline H may be longer than that parallel to the centerline H. Accordingly, more developer may pass through the developer outlet 114.

As necessary, at least one of the intervals S between the developer outlets 114 may be zero. That is, both ends of each developer outlet 114 may meet the neighboring developer outlet 114 with respect to the transverse direction to the feeding direction D. At that time, if the interval S is zero, the developer outlet 114 may be diagonally crossed to the centerline H. This is because the developer supplying member 113 may be weak at that portion due to less material being present at the portion as the developer outlet 114 is long.

Meanwhile, the developer conveying member 117 which connects the developer storing tank 111 and the developer supplying member 113 may be omitted as necessary. That is, the developer storing tank 111 and the developer supplying member 113 may be directly connected.

If necessary, the developer storing tank 111 and the developer supplying member 113 may be formed as a single body. Accordingly, a developer outlet communicating with the developing chamber K of the unit casing 121 is provided in the developer supplying unit 110 so as to supply the developer to the developing chamber K.

The agitator 115 may be provided in the developer supplying member 113. An elastic film 115*b* may be disposed on a blade 115*a* of the agitator 115 to sweep off the developer attached to an inside of the developer supplying member 113. A plurality of films 115*b* may be disposed along a lengthwise direction of the agitator 115 at a predetermined length with a predetermined distance therebetween.

The film 115*b* may be inserted in a groove 115*a*1 of the blade 115*a* so as not to generate noise during contact with an inner circumferential surface of the developer supplying member 113 according to the rotation of the agitator 115. That is, the film 115*b* is movable within the groove 115*a*1 (FIG. 5). Accordingly, the film 115*b* absorbs shock due to contact with the inner circumferential surface of the developer supplying member 113 and does not generate noise.

Besides, the film 115*b* may be disposed in the agitator 115 with various methods. The film 115*b* may movably connect to the agitator 115. At that time, the developer outlet 114 (to be described later) may be shorter than the film 115*b* so as to prevent the film 115*b* from being separate from the agitator 115 and to move to the developing chamber K via the developer outlet 114.

Figure 7A:
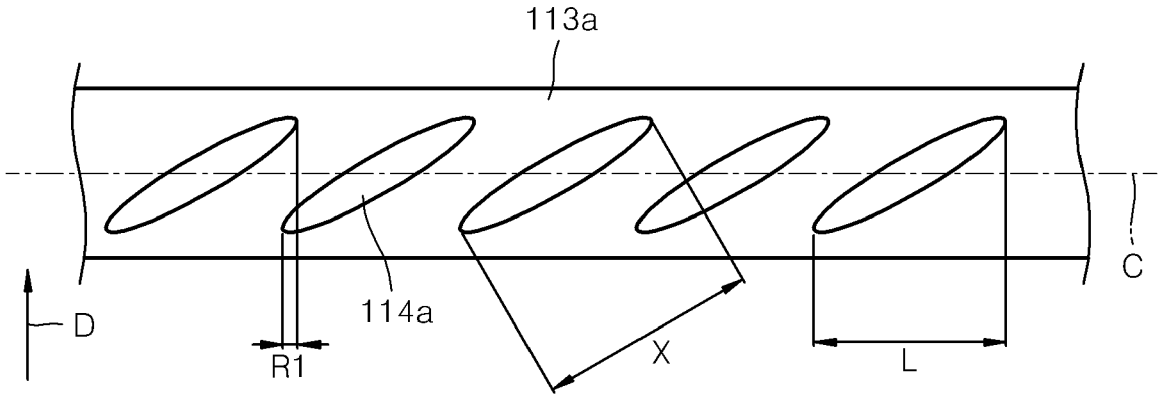
FIGS. 7A through 7C are schematic plan views illustrating the developer supplying member having a developer outlet with different shapes.
Figure 7B:
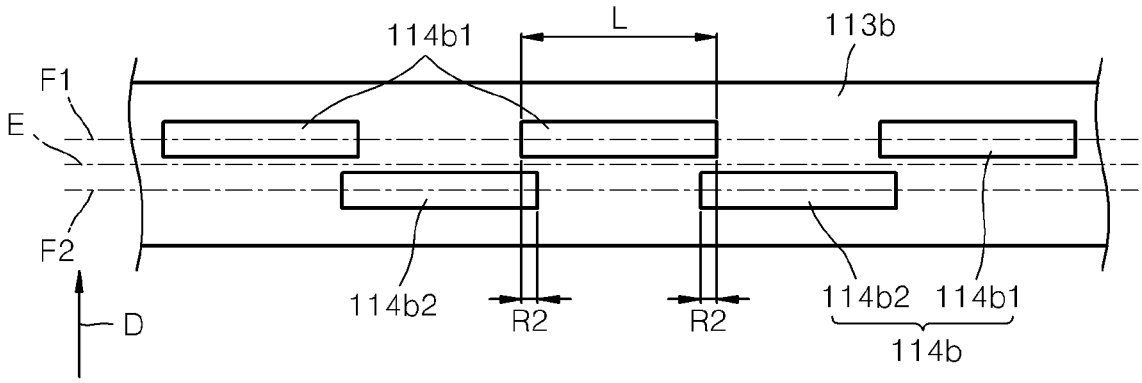
Figure 7C:
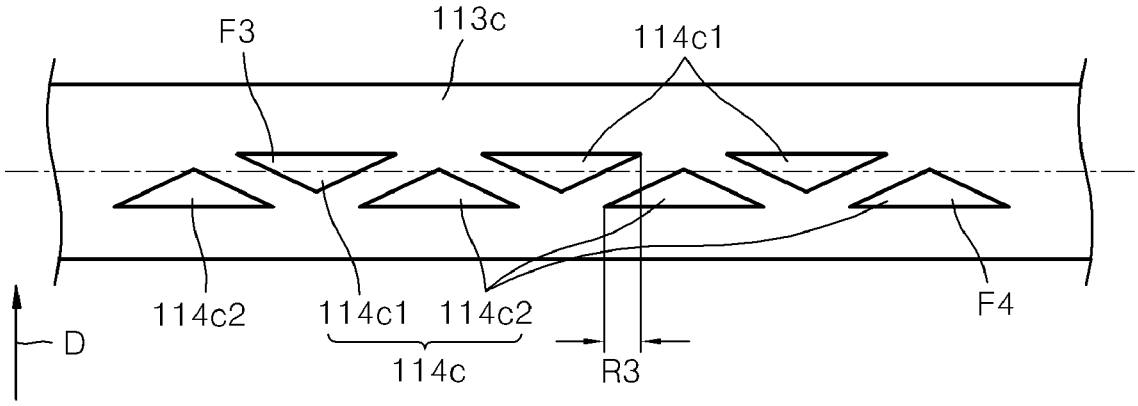

Meanwhile, FIGS. 7A through 7C are plan views illustrating the developer supplying members 113*a*, 113*b*, and 113*c* having developer outlets with different shapes. The image forming apparatus according to the present general inventive concept may use one of the developer supplying members 113*a*, 113*b*, and 113*c* as illustrated in FIGS. 7A through 7C, instead of the developer supplying member 113.

Figure 2A:
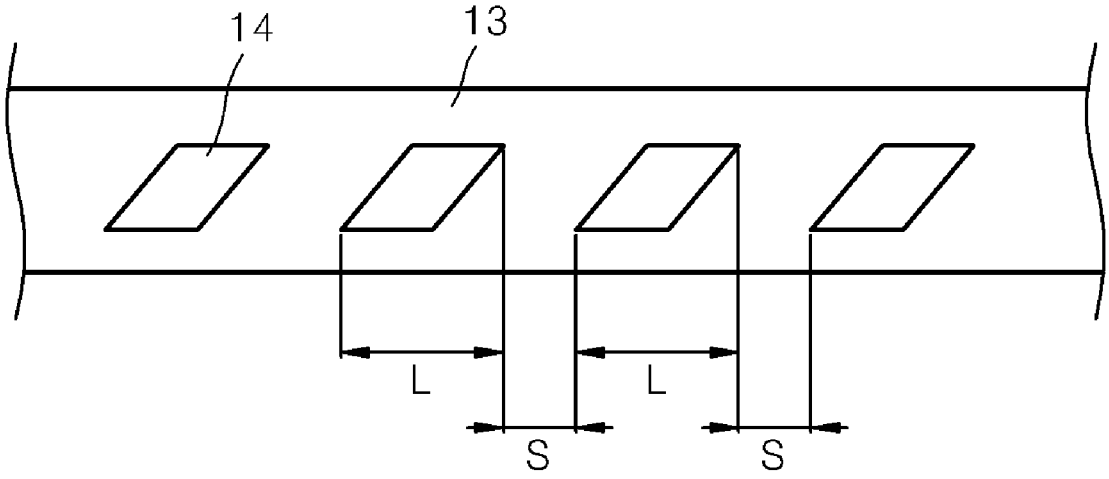
FIG. 2A (RELATED ART)
FIGS. 2A and 2B are schematic plan views illustrating a developer supplying member of the image forming apparatus in FIG. 1.
Figure 2B:
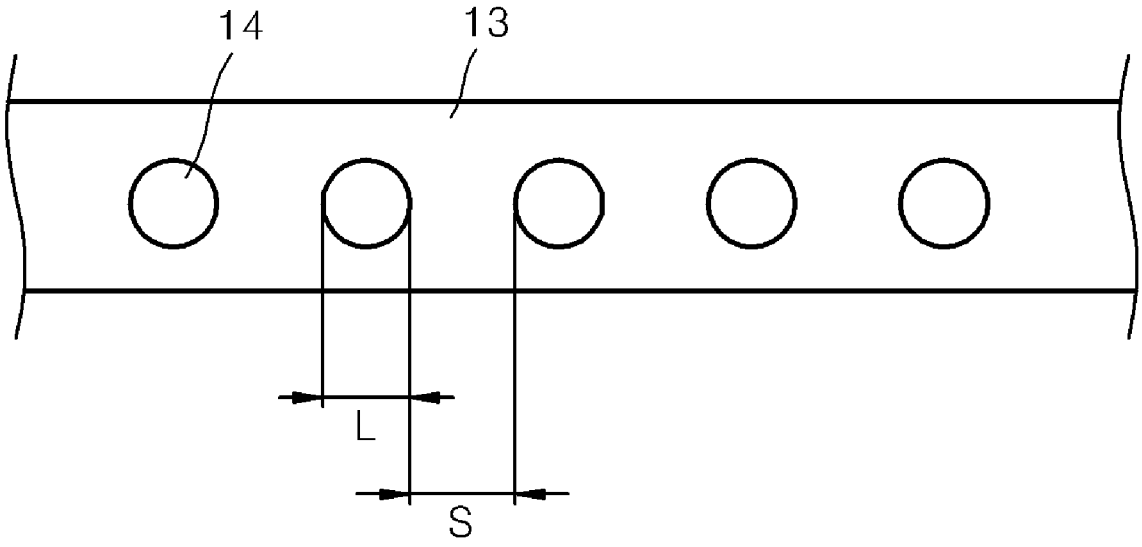
FIG. 2B (RELATED ART)

As compared with FIG. 6, the developer outlets 114*a* in FIG. 7A overlap along a traverse direction to the feeding direction D of the printing medium, i.e., along a direction traverse to the rotation direction of the rotating bodies 122 through 126. That is, as illustrated in FIG. 7A, there is an overlapped region R1 resulting in no interval (S in FIGS. 2A, 2B, and 6) being provided between the developer outlets 114*a* and blocking the developer. The developer may be provided to every region in the length direction of the developer supplying member 113*a*. Accordingly, the developer is uniformly supplied along the transverse direction to the feeding direction D, so that the image concentration is prevented from varying.

Also, hardness of the developer supplying member 113 is higher than that formed with a single developer outlet along the lengthwise direction of the developer supplying member 113. Accordingly, the image concentration becomes uniform without changing the strength of the developer supplying member 113.

As illustrated in FIG. 7A, the developer outlet 114*a* may be formed as an oval shape. The lengthwise direction X of the developer outlet 114*a* may be diagonally crossed to the centerline C.

Alternatively, the developer supplying member 113*b* may have the developer outlet 114*b* as illustrated in FIG. 7B.

The developer outlets 114*b* are arranged as two lines parallel to the centerline E of the developer supplying member 113*b*. That is, the developer outlet 114*b* may be provided as a first outlet row F1 spaced apart from the centerline E to one side and a second outlet row F2 parallel to the first outlet row F1.

The first outlet row F1 and the second outlet row F2 include a plurality of first developer outlets 114*b*1 and a plurality of second developer outlets 114*b*2 along the lengthwise direction of the developer supplying member 113*b* at predetermined intervals, respectively. The first developer outlet 114*b*1 and the second developer outlet 114*b*2 are alternately disposed to form an overlapped region R2 along a direction transverse to the feeding direction D. Accordingly, the developer can be supplied throughout the developer supplying member 113*b* in the lengthwise direction of the developer supplying member 113*b* as the interval placed between the developer outlets 114*b* and the blocking of the developer disappears. Accordingly, the image density may be prevented from being changed along the transverse direction to the feeding direction D.

Alternatively, the developer supplying member 113*c* may have the developer outlet 114*c* as illustrated in FIG. 7C.

The developer outlet 114*c* may be formed as a triangle. Also, there is an overlapped region R3 to overlap each other along a direction traverse to the feeding direction D. The developer outlet 114*c* includes a first outlet row F3 where a plurality of first developer outlets 114*c*1 are arranged leaving a space therebetween along the lengthwise direction of the developer supplying unit 113*c*, and a second outlet row F4 where a plurality of second developer outlet 114*c*2 are arranged leaving a space therebetween along the lengthwise direction of the developer supplying unit 113*c*. The first developer outlet 114*c*1 and the second developer outlet 114*c*2 may be formed as an inverted triangle and the triangle, respectively.

The printing process of the image forming apparatus with this configuration will be briefly explained below. First, a charging roller 122 charges the surface of a photosensitive body 124 to a predetermined electric potential. The charged surface of the photosensitive body 124 is exposed to the light corresponding to the image information scanned from an exposing unit (not illustrated). Accordingly, a latent image corresponding to the image information is formed on the surface of the photosensitive body 124.

The developer is supplied from the developing chamber K through the developer outlet 114 of the developer supplying member 113 and then provided to the developing roller 125 by the supplying roller 126. The doctor blade 129 controls the supplied developer to achieve a predetermined thickness and to be applied to an outer circumferential surface of the developing roller 125, and spread on the electrostatic latent image of the photosensitive body 124. Accordingly, a visual image composed by the developer is formed on the photosensitive body 124.

The visible image is transferred to the printing medium P advanced between the transferring roller 130 and the photosensitive body 124, and is fused on the printing medium P by the heat and the pressure using a fusing device (not illustrated). The fused printing medium P is discharged to thereby complete printing.

Figure 8:
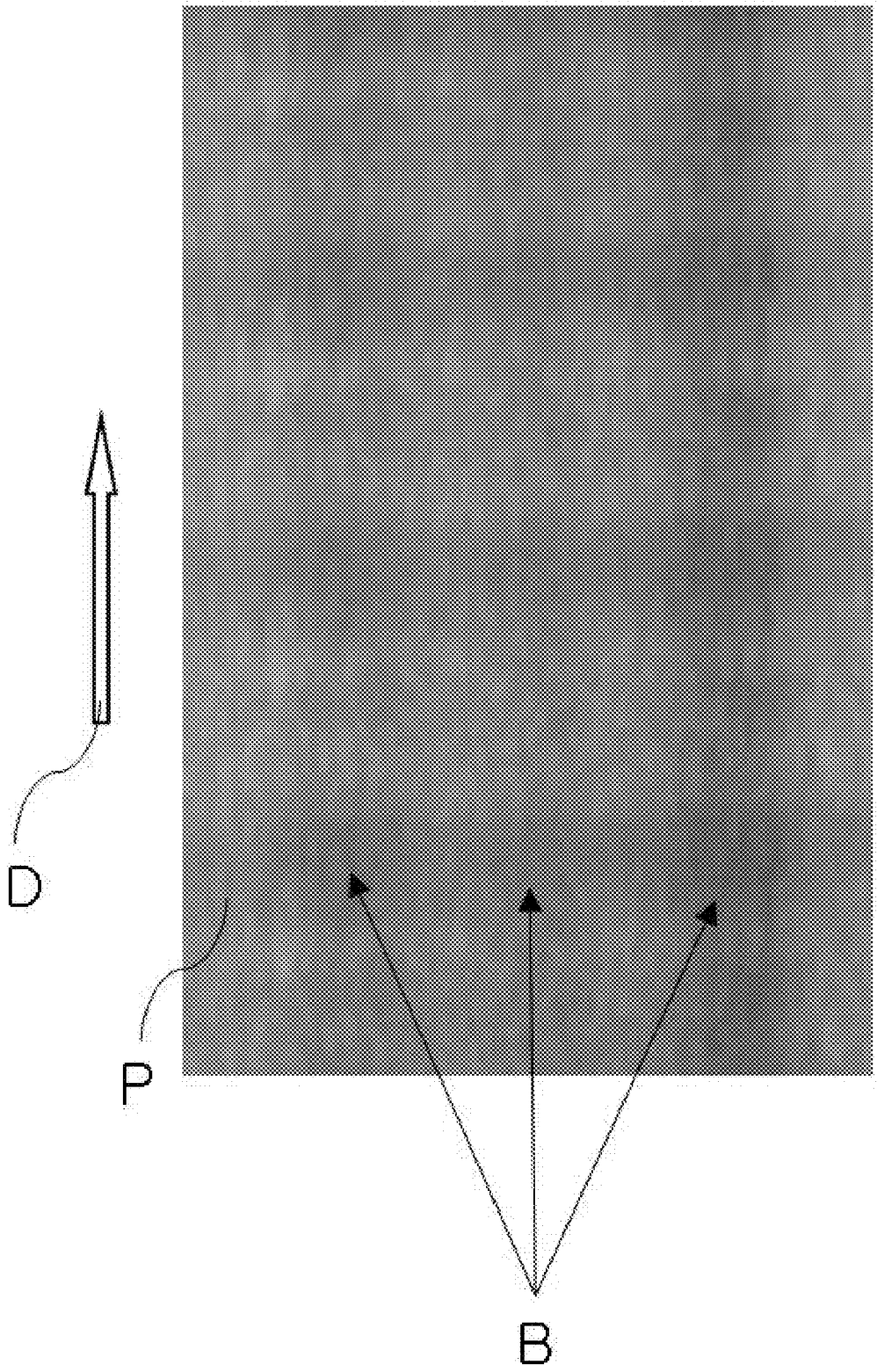
FIG. 8 is a photograph illustrating a printing medium printed thereon by the image forming apparatus in FIG. 4.

Herein, FIG. 8 is a portion of a photograph of the printing medium printed thereon by the image forming apparatus 100 having the developer supplying member 113 in FIG. 6. The printing is operated under the same conditions as FIG. 3. Also, the photograph region of FIG. 8 corresponds to that of FIG. 3.

Figure 3:
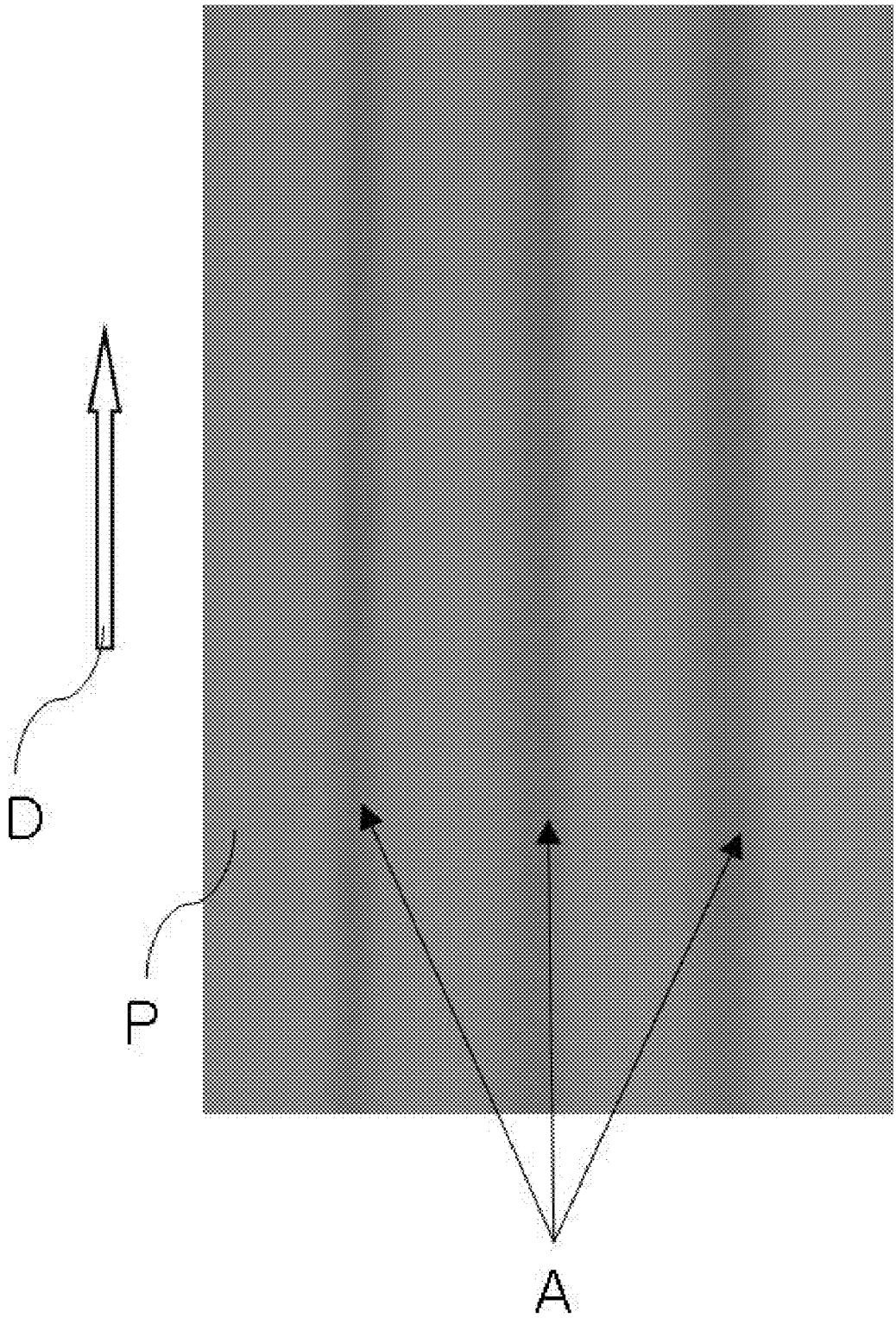
FIG. 3 is a photograph illustrating a printing medium printed thereon by the image forming apparatus in FIG. 1.

FIG. 8, illustrates a printing medium printed thereon in accordance with the present general inventive concept. FIG. 3 illustrates a printing medium printed in accordance with the conventional image forming apparatus 1. A comparison of FIGS. 8 and 3 reveals that a black image line B faintly appears in FIG. 8, but a black image line A clearly appears in FIG. 3 along the feeding direction D. That is, the image concentration in the transverse direction to the feeding direction D is relatively uniform as compared with the conventional image forming apparatus 1.

The image forming apparatus according to the present general inventive concept has following effects.

First, the developer may be provided through the developer outlet along an overall region in the transverse direction to the feeding direction of the printing medium. Accordingly, the change of the image concentration in the transverse direction may be minimized, even if there is no fluidity in the transverse direction to the feeding direction in the developing chamber.

Second, the hardness of the developer supplying member may increase relatively.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a developing unit including a unit casing to form a developing chamber and a rotating body which is rotatably provided in the developing chamber;

a developer supplying unit comprising:

a developer storing tank to store a developer therein;

a hollow developer supplying member accommodated in the developing chamber; and a plurality of developer outlets which are overlapped with at least one adjacent developer outlet along a rotation direction of the rotating body on an outside surface thereof;

an image bearing member having a surface on which a visual image is formed by the developing unit;

a transferring unit to transfer the visual image of the image bearing member to a printing medium; and a fixing unit to fix the transferred visual image on the printing medium, wherein the hollow developer supplying member comprises:

a developer inlet through which the developer from the developer storing tank flows in; and the plurality of developer outlets formed on an outside surface thereof.

2. The image forming apparatus according to claim 1, wherein the plurality of developer outlets is provided in a crossing direction to a centerline of the developer supplying member.

3. The image forming apparatus according to claim 1, wherein the plurality of developer outlets comprises:

a first outlet row which comprises a plurality of first developer outlets along a lengthwise direction of the developer supplying unit; and a second outlet row which comprises a plurality of second developer outlets alternately disposed to the first developer outlets and spaced apart from the first outlet row in a transverse direction to the lengthwise direction.

4. The image forming apparatus according to claim 3, wherein at least one of the first developer outlets and the second developer outlets has at least one of a triangular shape and an oval shape.

5. The image forming apparatus according to claim 3, wherein at least one of the first developer outlets and the second developer outlets has at least one of a rectangular shape and a slit.

6. An image forming apparatus comprising:

a developing unit including a unit casing to form a developing chamber and a rotating body which is rotatably provided in the developing chamber;

a developer supplying unit to store a developer therein and including a plurality of developer outlets which are overlapped with at least one adjacent developer outlet along a rotation direction of the rotating body on an outside surface thereof;

an image bearing member having a surface on which a visual image is formed by the developing unit;

a transferring unit to transfer the visual image of the image bearing member to a printing medium;

a fixing unit to fix the transferred visual image on the printing medium, wherein the developer supplying unit further comprises:

a developer storing tank; and a hollow developer supplying member accommodated in the developing chamber, and an agitator provided inside the developer supplying member to agitate the developer.

7. The image forming apparatus according to claim 1, wherein the plurality of developer outlets is provided as at least one slit.

8. The image forming apparatus according to claim 1, wherein the plurality of developer outlets is provided in a crossing direction to a centerline of the developer supplying member.

9. The image forming apparatus according to claim 1, wherein the plurality of developer outlets comprises:

a first outlet row which comprises a plurality of first developer outlets along a lengthwise direction of the developer supplying unit.

10. The image forming apparatus according to claim 9, wherein the plurality of developer outlets further comprises:

a second outlet row which comprises a plurality of second developer outlets alternately disposed to the first developer outlets, and spaced apart from the first outlet line in a transverse direction to the lengthwise direction.

11. The image forming apparatus according to claim 10, wherein at least one of the first developer outlet and the second developer outlet has at least one of a triangular shape an oval shape and a rectangular shape.

12. A developer supplying unit usable with an image forming apparatus, the developer supplying unit comprising:

a developer supplying member having a developer storing portion to store developer and a plurality of developer outlets arranged along a lengthwise direction of the developer supplying member to emit the developer to a supplying roller of the image forming apparatus, wherein at least a portion of each adjacent developer outlet overlaps each other in the lengthwise direction.

13. The developer supplying unit of claim 12, wherein:

the plurality of developer outlets are substantially aligned in a crossing direction to a centerline of the developer supplying member; and a length of each developer outlet crossing the centerline is longer than a length of each developer outlet parallel to the centerline.

14. The developer supplying unit of claim 12, further comprising:

an agitator including one or more blades having a groove to agitate the developer; and a film disposed in the groove of the blade to reduce noise during contact with an inner surface of the developer supplying member.

15. The developer supplying unit of claim 12, wherein:

the plurality of developer outlets are arranged in a first outlet row and a second outlet row, the first outlet row spaced apart from a centerline to one side and the second outlet row parallel to the first outlet row, wherein a respective developer outlet of the first outlet row overlaps a respective developer outlet of the second outlet row in the lengthwise direction of the developer supplying member.

16. The developer supplying unit of claim 12, wherein the plurality of developing outlets comprise:

a shape of at least one of an oval, a square, a triangle and an inverted triangle.

17. An image forming apparatus, comprising:

a supplying roller;

a developer supplying unit comprising:

a developer supplying member having a developer storing portion to store developer and a plurality of developer outlets arranged along a lengthwise direction of the developer supplying member to emit the developer to the supplying roller, wherein at least a portion of each adjacent developer outlet overlaps each other in the lengthwise direction;

an image bearing member having a surface on which a visual image is formed by the developing unit;

a transferring unit to transfer the visual image of the image bearing member to a printing medium; and a fixing unit to fix the transferred visual image on the printing medium.

18. An image forming apparatus, comprising:

a developing unit which comprises a unit casing to form a developing chamber, and a rotating body which is rotatably provided in the developing chamber;

a developer supplying unit comprising:

a developer storing tank to store a developer therein;

a hollow developer supplying member accommodated in the developing chamber; and a plurality of developer outlets to allow the developer to be supplied to the developing chamber continuously along a lengthwise direction of the rotating body;

an image bearing member having a surface on which a visual image is formed by the developing unit;

a transferring unit to transfer the visual image of the image bearing member to a printing medium; and a fixing unit to fix the transferred visual image on the printing medium wherein the hollow developer supplying member comprises:

a developer inlet through which the developer from the developer storing tank flows in; and the plurality of developer outlets formed on an outside surface thereof.

* * * * *